US006186911B1

(12) United States Patent
Manthey

(10) Patent No.: US 6,186,911 B1
(45) Date of Patent: Feb. 13, 2001

(54) RESILIENT BASKETBALL GOAL AND METHOD OF PREPARING FOR ASSEMBLY

(75) Inventor: Brian Manthey, Milwaukee, WI (US)

(73) Assignee: Huffy Corporation, Miamisburg, OH (US)

( * ) Notice: Under 35 U.S.C. 154(b), the term of this patent shall be extended for 0 days.

(21) Appl. No.: 09/339,216

(22) Filed: Jun. 24, 1999

(51) Int. Cl.[7] ..... A63B 63/08
(52) U.S. Cl. ..... 473/486
(58) Field of Search ..... 473/485–489

(56) References Cited

U.S. PATENT DOCUMENTS

| | | | | |
|---|---|---|---|---|
| 3,788,642 | | 1/1974 | Matras et al. . | |
| 4,194,734 | | 3/1980 | Tyner . | |
| 4,348,022 | | 9/1982 | O'Donnell . | |
| 4,397,464 | | 8/1983 | Krug . | |
| 4,433,839 | | 2/1984 | Simonseth . | |
| 4,438,923 | | 3/1984 | Engle et al. . | |
| 4,441,709 | | 4/1984 | Schroeder et al. . | |
| 4,483,534 | | 11/1984 | O'Donnell . | |
| 4,575,079 | | 3/1986 | De Faveri . | |
| 4,583,732 | | 4/1986 | Allen . | |
| 4,799,679 | | 1/1989 | Obram . | |
| 4,846,469 | | 7/1989 | Nye . | |
| 5,480,139 | | 1/1996 | Owen, Jr. et al. . | |
| 5,685,790 | * | 11/1997 | Vaught | 473/486 |
| 5,816,955 | | 10/1998 | Nordgran et al. . | |
| 5,830,090 | * | 11/1998 | Fitzsimmons et al. | 473/486 |
| 6,080,071 | * | 6/2000 | Childers et al. | 473/486 |

FOREIGN PATENT DOCUMENTS 2615261 12/1987 (FR) .

* cited by examiner

*Primary Examiner*—Mark S. Graham
(74) *Attorney, Agent, or Firm*—Howrey Simon Arnold & White; Michael J. Bell

(57) ABSTRACT

A resilient basketball goal assembly having a substantially u-shaped back plate, having side elements, an inside back surface, and an outside back surface adapted to attach to a vertical surface such as a basketball backboard. There is a top plate having a top surface and a bottom surface, a front edge, a back edge, and downwardly extending sidewalls pivotally connected to the back plate. In a resting position, the top surface of the top plate is essentially even with the top edge of the back plate and is substantially perpendicular to the vertical surface. The top plate pivots about a pivot point proximate the front edge of the side elements of the back plate. An angle bracket is coupled to the inside back surface of the back plate such that a portion of the angle bracket extends inwardly perpendicular from the back plate and is parallel to the top plate in the resting position. A carriage bolt extends from the top surface of the top plate through the inwardly extending portion of the angle bracket. An elasticity accelerating member is disposed beneath the angle bracket and is adapted to receive the carriage bolt. A first adjustment element is disposed above the angle bracket and is threadedly engaged with the carriage bolt. A second adjustment element is disposed below the elasticity accelerating member and is threadedly engaged with the carriage bolt for adjusting the spring rate of the elasticity accelerating member and the position of the basketball hoop relative to the playing surface.

12 Claims, 4 Drawing Sheets

RESILIENT BASKETBALL GOAL AND METHOD OF PREPARING FOR ASSEMBLY

BACKGROUND OF THE INVENTION

1. Field of the Invention

The invention relates generally to basketball goals. In particular, the invention relates to resilient basketball goals with flexible hoops and the assembly thereof.

2. Description of Related Art

It has become commonplace in the sport of basketball for players to attempt to dunk the ball in the rim. Many players, whether intentionally or not, tend to place a great deal of force on the rim such that the backboard to which the rim is attached is damaged or fractured. Proposals have been made in the past to provide a resilient connection between the rim and the backboard. Such proposals have recognized that while a rigid connection is desirable, flexibility of the assembly is essential to prevent damage to the backboard.

Flexible basketball goal assemblies that have been developed are complex and require a great deal of effort to assemble. Such assemblies are assembled by the manufacturer due to their complexity. The cost of these goals is high due to the nature of the components involved as well as the cost of assembling the components. Moreover, the manufacturer is able to produce fewer goals because of the time requirement to assemble each unit. Additionally, once assembled, the basketball goal takes up more shipping space than if the components of the goal were being shipped unassembled. This not only results in increased shipping costs, but also presents the manufacturer or retailer with storage concerns.

Consumers cannot, however, be expected to assemble complex items such as conventional flexible goal assemblies. The notion of consumer assembly of the complex goals described above is contrary to most business practices. Such assemblies comprise numerous complex components which, if assembled improperly, could cause a complete failure of the goal and possible injury to the user as assembled. Such systems are better left to be assembled by the manufacturer to guarantee proper use and prevent injury by the consumer.

There are resilient basketball goals that have flexible support structures such as springs or hydraulic cylinders which are effective, but extremely complex as noted above. Several of these goals require the flexible support to be placed behind the backboard. Although these goals may be effective, their use is limited. For example, if such a goal was desired by a user, but that user did not have an existing backboard, they would need to purchase a backboard suitable to accommodate such a goal. If the flexible support were located entirely in front of the backboard, the goal could alternatively be attached to a vertical surface such as the wall of a house or the like.

Another concern with certain proposed resilient basketball goals is that they have fixed spring rates. The basketball goals are typically constructed such that the spring or other dampening device is set at a particular spring rate and cannot be adjusted. This could pose a problem after prolonged usage or for different levels of play. For example, if a player continuously "dunks" the ball in the goal, the spring rate will decrease over time. This problem could be solved, or at least delayed, by continuously tightening the spring and increasing the spring rate. Similarly, the spring rate could be decreased to allow for greater flexibility during periods of continuous "dunking." With goals that do not provide an adjustable spring, however, such adjustment is not possible.

Yet another concern with proposed resilient basketball goals is that the dampening assembly in the rim often tends to position the rim in such a manner that it is not parallel with the playing surface. This could be problematic for the user since the complexity of the basketball goal prevents the user from being able to make adjustments to the goal which would rectify the problem.

The foregoing demonstrates that there is a need for a resilient basketball goal assembly that is easily assembled by the consumer and adjusted by the user.

SUMMARY OF THE INVENTION

Additional features and advantages of the invention will be set forth in the description which follows, and in part will be apparent from the description, or may be learned by practice of the invention. The objectives and other advantages of the invention will be realized and attained by the apparatus particularly pointed out in the written description and claims hereof as well as the appended drawings.

To achieve these and other advantages and in accordance with the purpose of the invention, as embodied and broadly described, the invention consists of a resilient basketball goal having a substantially unshaped back plate, having side elements, an inside back surface, and an outside back surface adapted to attach to a vertical surface. The side elements extend outwardly perpendicular to the vertical surface and terminate in a front edge.

There is a top plate having a top surface and a bottom surface, a front edge, a back edge, and downwardly extending sidewalls pivotally connected to the back plate. In a resting position, the top edge of the top plate is essentially even with the top edge of the back plate and is substantially perpendicular to the vertical surface. The top plate pivots about a pivot point proximate the front edge of the side elements of the back plate. There is an annular connecting member connecting a basketball hoop and the front edge of the top plate. An angle bracket is coupled to the inside back surface of the back plate such that a portion of the angle bracket extends inwardly perpendicular from the back plate and is parallel to the top plate in the resting position. A carriage bolt extends from the top surface of the top plate, proximate the back plate, through the inwardly extending portion of the angle bracket.

A retention nut threadedly engages the carriage bolt and abuts the bottom surface of the top plate. An elasticity accelerating member is disposed beneath the angle bracket and is adapted to receive the carriage bolt. A first adjustment element is disposed above the angle bracket and is threadedly engaged with the carriage bolt. A second adjustment element is disposed below the elasticity accelerating member and is threadedly engaged with the carriage bolt for adjusting the spring rate of the elasticity accelerating member and for positioning the basketball hoop relative to the playing surface such that the hoop is substantially parallel to the playing surface.

In another aspect of the invention, a method of preparing a resilient basketball goal for assembly is described. The method comprises manufacturing the goal components, packaging the goal components for shipment and providing the unassembled goal components to a consumer for assembly.

In operation, when a force is placed on the basketball rim the top plate will be displaced from its resting position, pivoting around the pivot point near the front of the back plate. The carriage bolt/elasticity accelerating member assembly, while allowing a small displacement of the top plate and rim, ensure that the top plate returns to its resting position. The flexibility of the rim and top plate prevent large forces from being imparted on the connection between the back plate and backboard. The amount of flexibility of the rim can be adjusted by changing the position of the two adjustment elements relative to the angle bracket and elasticity accelerating member.

It is an object of the present invention to provide a resilient basketball goal.

It is another object of an embodiment of the present invention to provide a resilient basketball goal with adjustable flexibility.

It is a further object of the invention to provide a basketball goal that can be adjusted by the consumer to position the basketball hoop relative to the playing surface.

It is yet another object of the present invention to provide a resilient basketball goal that is easily assembled by a consumer.

It is still another object of the present invention to provide a resilient basketball goal that is easily adjusted by a consumer.

These and other objects of the present invention will become readily apparent upon further review of the following specification and drawings. It is understood that both the foregoing general description and the following detailed description are exemplary and explanatory and are intended to provide further explanation of the invention as claimed.

The accompanying drawings are included to provide a further understanding of the invention and are incorporated in and constitute a part of this specification, illustrate several embodiments of the invention and, together with the description, serve to explain the principles of the invention.

BRIEF DESCRIPTION OF THE DRAWINGS

Similar reference characters denote corresponding features consistently throughout the attached drawings.

DETAILED DESCRIPTION OF THE PREFERRED EMBODIMENTS

Reference will now be made in detail to the present preferred embodiment of the invention, an example of which is illustrated in the accompanying drawings.

Figure 1:
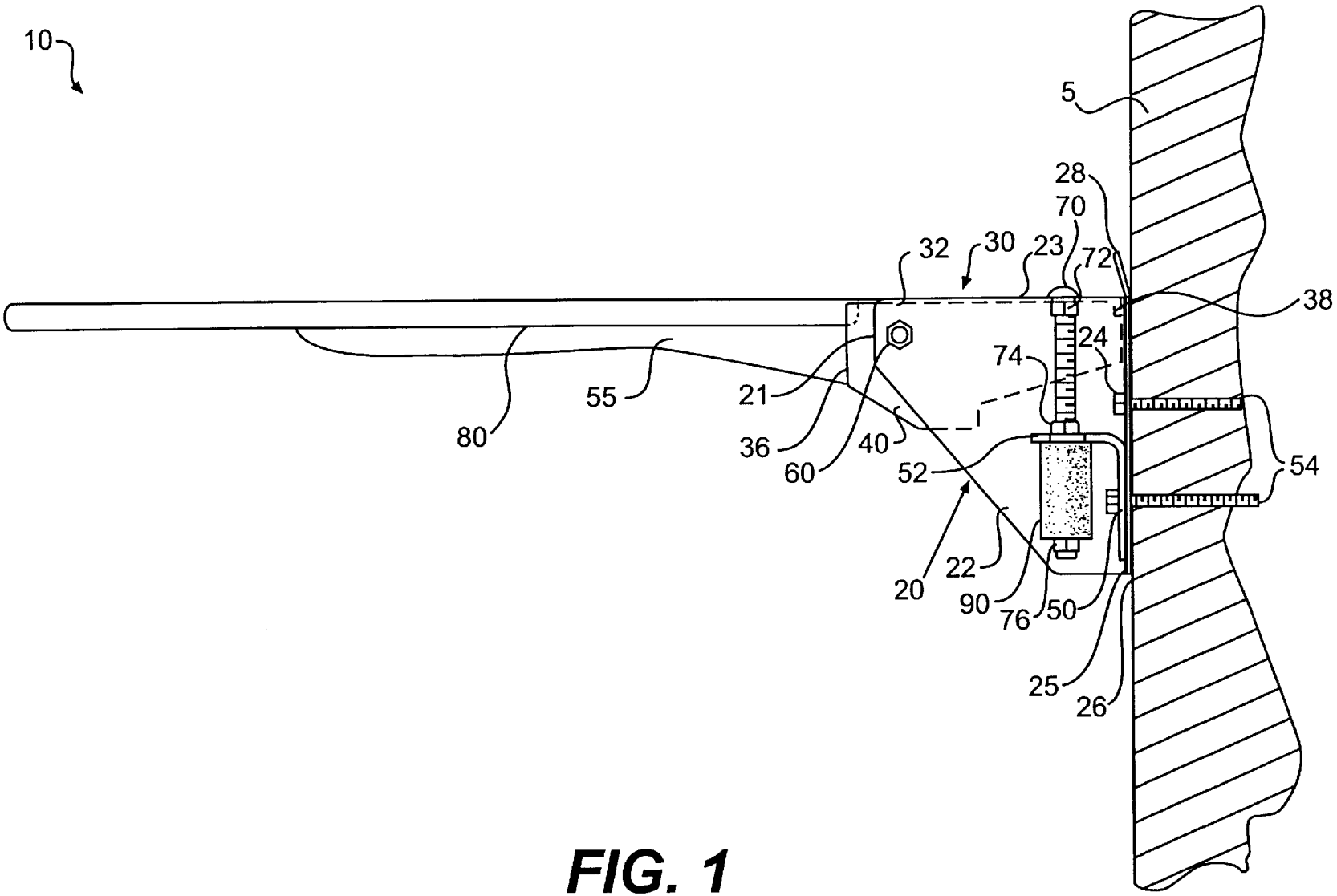
FIG. 1 is a side elevation of the resilient basketball goal assembly according to the present invention.
Figure 2:
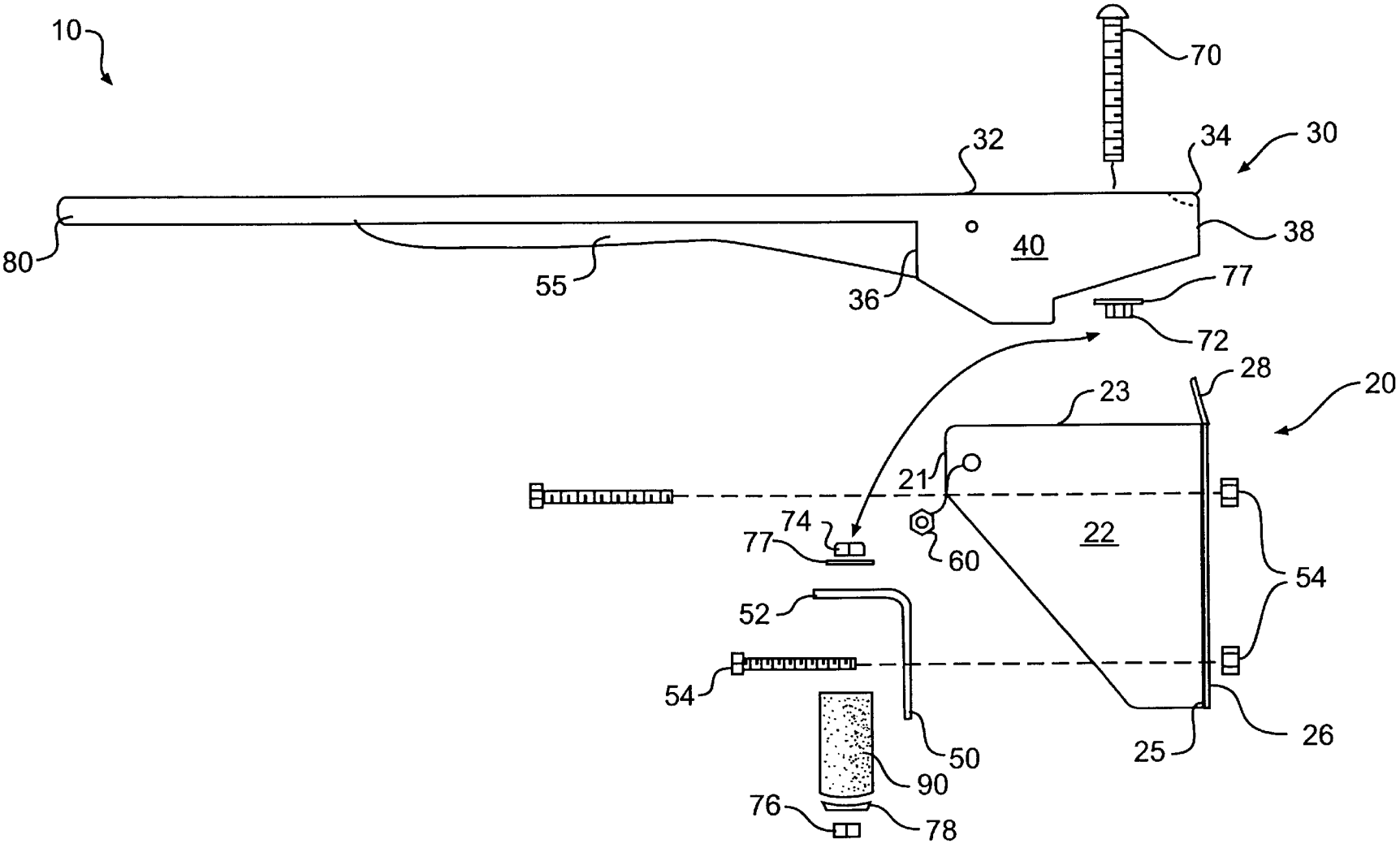
FIG. 2 is an exploded side view of the assembly according to the present invention.
Figure 3:
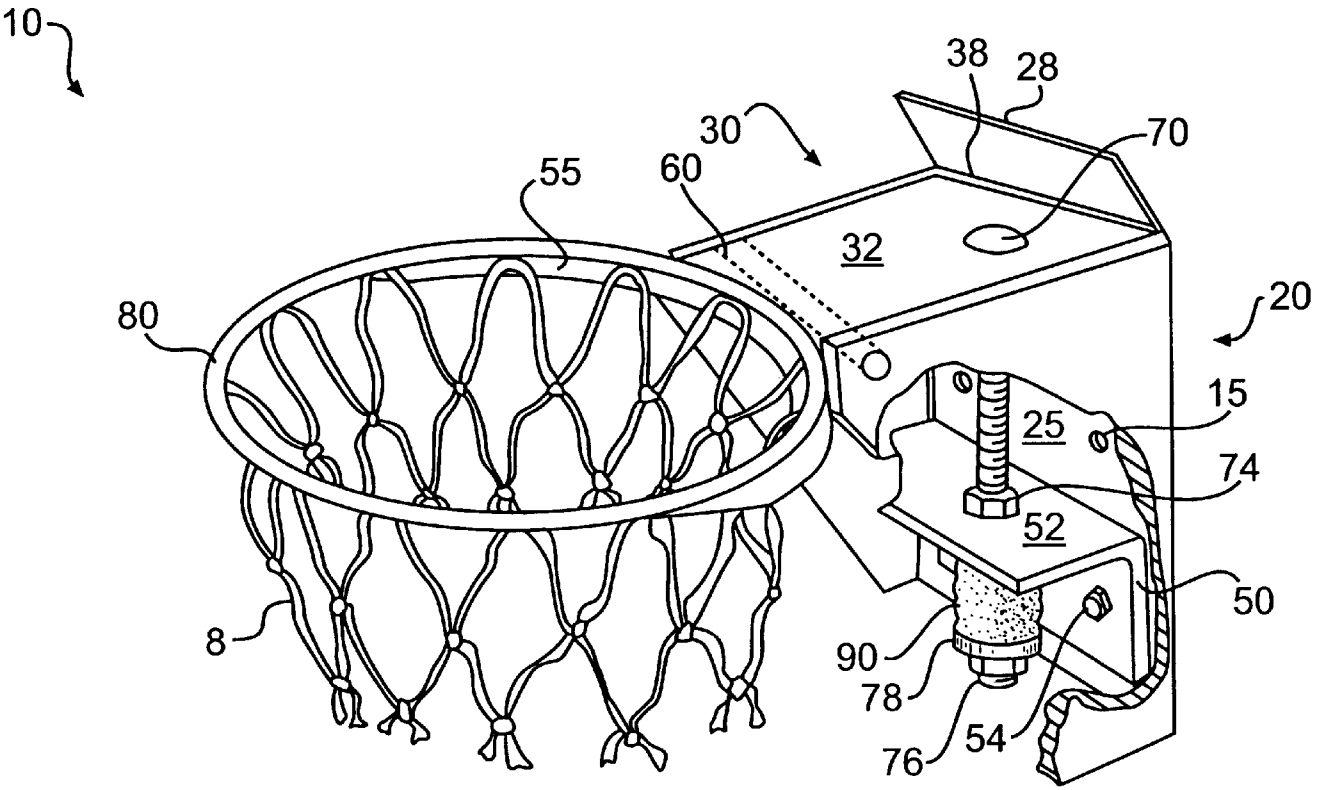
FIG. 3 is a partial cut-out perspective view of the assembly according to the present invention.

An exemplary embodiment of a consumer assembleable resilient basketball goal assembly is shown in FIGS. 1–3 and is designated generally by reference numeral 10. As embodied herein and referring to FIGS. 1–3, the goal assembly 10 includes a substantially u-shaped back plate 20, having side elements 22, a back wall 24 with an inside back surface 25 and an outside back surface 26 adapted to attach to a vertical surface 5. The vertical surface 5 to which the back plate 20 attaches is preferably a basketball backboard. Alternatively, the vertical surface 5 may be a wall of a house or building or some such surface. The back plate 20 has holes and slots 15 through the back wall 24 for attaching the goal assembly 10 to the vertical surface 5. The basketball goal assembly 10 may be attached to the vertical surface 5 using methods known to those of ordinary skill in the art and that are easily performed by a consumer.

The side elements 22 of the u-shaped back plate 20 extend outwardly substantially perpendicular to the vertical surface 5 and terminate in a front edge 21. There is a top portion 28 of the back plate 20 which extends above the side elements 22 and is angled inwardly. There is a top plate 30 having a top surface 32 and a bottom surface 34, a front edge 36, a back edge 38, and downwardly extending sidewalls 40 pivotally connected to the back plate 20. In the resting position, the top surface 32 of the top plate 30 is essentially even with the top edge 23 of the back plate 20 and is substantially perpendicular to the vertical surface 5. The downwardly extending sidewalls 40 are preferably disposed between the side elements 22 of the back plate 20. The sidewalls 40 are dimensioned to substantially engage an angle bracket 50 when the hoop 80 is forced downward to prevent protracted flexion of the basketball goal 10. There is a pivot point 60 proximate the front edge 21 of the side elements 22 of the back plate 20 around which the top plate 30 pivots. The pivot point 60 preferably comprises a bolt 60 disposed between, and extending through, the side elements 22 of the back plate 20 and the sidewalls 40 of the top plate 30. An annular connecting member 55 is fixedly connected between the basketball hoop 80 and the front edge 36 of the top plate 30. The annular connecting member 55 provides a greater surface area for the top plate 30 to connect with than would the basketball hoop 55 itself.

The angle bracket 50 is coupled to the inside back surface 25 of the back plate 20 such that a portion 52 of the angle bracket 50 extends inwardly perpendicular from the back plate 20 and is parallel to the top plate 30 in its resting position. The angle bracket 50 is preferably a common L-shaped bracket. The angle bracket 50 is preferably secured to the back plate 20 by a nut and bolt assembly 54.

A carriage bolt 70 extends from the top surface 32 of the top plate 30, proximate the back plate 20, through the inwardly extending portion 52 of the angle bracket 50. There is a retention nut 72 theadedly engaging the carriage bolt 70 and abutting the bottom surface 34 of the top plate 30. The retention nut 72 essentially secures the carriage bolt 70 to the top plate 30, thereby providing a rigid connection between the two. As would be obvious to one of ordinary skill in the art, any of a variety of washers or spacers may be placed between the retention nut 72 and the bottom surface 36 of the top plate 30 to obtain a more secure connection.

There is an elasticity accelerating member 90 that is disposed beneath the inwardly extending portion 52 of the angle bracket 50 and is adapted to receive the carriage bolt 70. The elasticity accelerating member 90 is preferably a rubber grommet, but can alternatively be a spring, piston and cylinder device, or other such device known to those of ordinary skill in the art. In order to adjust the elasticity of the basketball goal assembly 10, there is a first adjustment element 74 disposed above the inwardly extending portion 52 of the angle bracket 50 that is engaged with the carriage bolt 70, and there is a second adjustment element 76 disposed below the elasticity accelerating member 90 that is engaged with the carriage bolt 70. The two adjustment elements 74, 76 are preferably internally threaded nuts which may have washers 77 between them and the surface with which they come in contact. By tightening the adjustment elements 74, 76, and subsequently compressing the elasticity accelerating member 90, the spring rate of the elasticity accelerating member 90 is increased. Alternatively, the second adjustment element 76 may include a seat member 78 disposed between the adjustment element 76 and the elasticity accelerating member 90. The seat element 78 is dimensioned to substantially support the elasticity accelerating member 90 such that when the second adjustment element 76 is tightened, the seat member 78 applies an even distribution of force about the contacting surface of the elasticity accelerating member 90. The basketball goal 10 includes a basketball net 8 which is attached to the basketball hoop 80 using methods known to those of ordinary skill in the art.

In operation, when a downward force is placed on the hoop 80, the top plate 30 pivots about the pivot point 60. The goal assembly 10 is allowed to flex due to compression of the elasticity accelerating member 90. The edge of top plate 30 closest to the inside back surface 25 of the back plate 20, when displaced from its resting position, will not be displaced above the inwardly angled top portion 28 of the back plate 20. Such a construction will prevent a player from getting caught between the separated components of the assembly 10. The elasticity accelerating member 90 provides the resilient force necessary to return the hoop 80 to its resting position.

The first adjustment element 74 and the second adjustment element 76 are also effective to change the position of the basketball hoop 80 relative to the playing surface. By manipulating the adjustment elements 74, 76, the user may ensure that the hoop 80 is substantially parallel to the playing surface. In the event that the elasticity accelerating member 90 becomes weakened and the hoop 80 tends to slant toward the playing surface, the user may readily readjust the adjustment elements 74, 76 to account for the deformation.

The components of the present invention are configured such that a consumer can readily assemble the goal assembly. There are no complex tools or equipment required to effect such assembly or to make adjustments to the assembly once completed.

Figure 4:
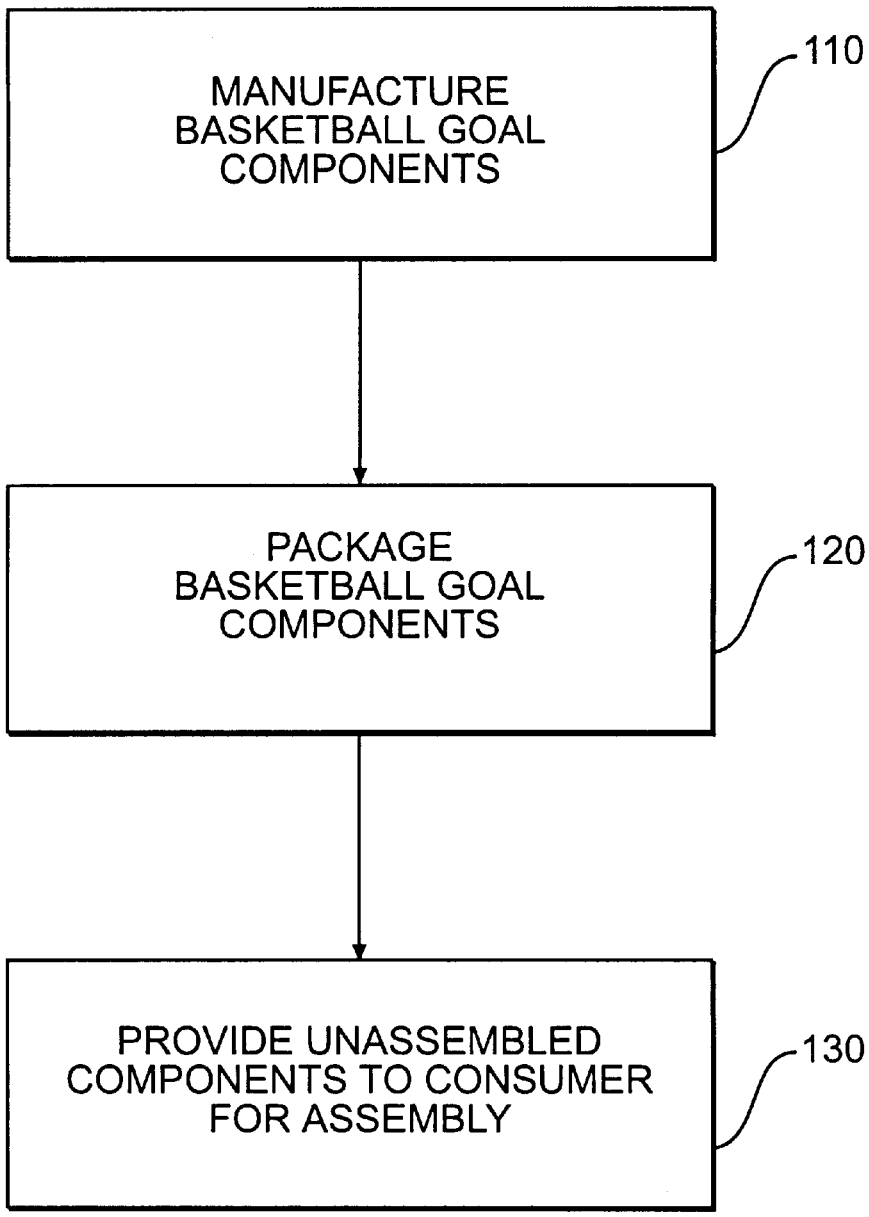
FIG. 4 is a flow diagram of the method according to the present invention.

A second aspect of the invention will now be described which is outlined in FIG. 4. As embodied herein and referring to FIG. 4, the method of preparing the basketball goal for assembly includes first manufacturing 110 the components of the basketball goal assembly. Following the manufacture 110 of the components, the individual components are packaged 120 in such a way that the box that is used for packaging is smaller than the box that would be required if the basketball goal assembly were assembled prior to packaging. Finally, the packaged 120 components are shipped to a consumer for assembly 130. As used herein, the term consumer refers to any recipient of the packaged basketball goal components after they leave the manufacturer. For example, the consumer includes the retailer if the retailer is the one that assembles the basketball goal. Alternatively, the consumer includes the end user if the end user is the one that assembles the basketball goal.

It will be apparent to those skilled in the art that various modifications and variations can be made in a resilient basketball goal and the method of assembly of the present invention without departing from the spirit or scope of the invention. Thus, it is intended that the present invention cover the modifications and variations of this invention provided they come within the scope of the appended claims and their equivalents.

I claim:

1. A consumer assembleable resilient basketball goal comprising:

a substantially unshaped back plate, having side elements, an inside back surface, and an outside back surface adapted to attach to a vertical surface, with the side elements extending outwardly perpendicular to the vertical surface and terminating in a front edge;

a top plate having a top surface and a bottom surface, a front edge, a back edge, and downwardly extending sidewalls pivotally connected to the back plate such that in a resting position, the top surface of said top plate is essentially even with a top edge of said back plate and is substantially perpendicular to the vertical surface;

a pivot point proximate the front edge of the side elements of said back plate;

an annular connecting member fixedly connected between a basketball hoop and the front edge of said top plate;

an angle bracket coupled to the inside back surface of said back plate such that a portion of said angle bracket extends inwardly perpendicular from said back plate and is parallel to said top plate in the resting position;

a carriage bolt extending from the top surface of said top plate, proximate said back plate, through the inwardly extending portion of said angle bracket;

a retention nut threadedly engaging the carriage bolt and abutting the bottom surface of said top plate;

an elasticity accelerating member disposed beneath the inwardly extending portion of said angle bracket and adapted to receive the carriage bolt;

a first adjustment element disposed above the inwardly extending portion of said angle bracket and threadedly engaged with the carriage bolt; and a second adjustment element disposed below said elasticity accelerating member and threadedly engaged with the carriage bolt for adjusting the spring rate of the elasticity accelerating member and the position of the basketball hoop relative to a playing surface;

wherein said basketball goal is configured to allow compact shipment of the disassembled basketball goal and to be readily assembled by a consumer.

2. The consumer assembleable resilient basketball goal of claim 1, said back plate further comprising an inwardly angled top portion extending above the side elements.

3. The consumer assembleable resilient basketball goal of claim 1, wherein said pivot point comprises a bolt disposed between, and extending through the side elements of said back plate and the sidewalls of said top plate.

4. The consumer assembleable resilient basketball goal of claim 1, wherein said angle bracket is coupled to the inside surface of said back plate by a nut and bolt assembly.

5. The consumer assembleable resilient basketball goal of claim 1, wherein said elasticity accelerating member is a rubber grommet.

6. The consumer assembleable resilient basketball goal of claim 1, wherein said elasticity accelerating member is spring.

7. The consumer assembleable resilient basketball goal of claim 1, wherein said elasticity accelerating member is a piston and cylinder assembly.

8. The consumer assembleable resilient basketball goal of claim 1, wherein said first adjustment element is an internally threaded nut and said second adjustment element is an internally threaded nut.

9. The consumer assembleable resilient basketball goal of claim 1 further comprising a seat element dimensioned for substantially contacting the elasticity accelerating member between said elasticity accelerating member and said second adjustment element.

10. The consumer assembleable resilient basketball goal of claim 1, wherein said sidewalls of said top plate are dimensioned to substantially engage said angle bracket when said hoop is forced downward.

11. The consumer assembleable resilient basketball goal of claim 1 further comprising a basketball net attached to said basketball hoop.

12. A method of preparing a resilient basketball goal for assembly comprising:

manufacturing goal components;

packaging the goal components for shipment; and providing the goal components unassembled to a consumer for assembly;

wherein the coal components comprise:

a substantially u-shaped back plate, having side elements and an inside back surface and an outside back surface, adapted to attach to a vertical surface with the side elements extending outwardly perpendicular to the vertical surface and terminating in a front edge, a top plate having a top surface and a bottom surface, a front edge, a back edge, and downwardly extending sidewalls for pivotally connecting to the back plate such that in a resting position, the top surface of said top plate is essentially even with a top edge of said back plate and is substantially perpendicular to the vertical surface;

a pivot point proximate the front edge of the side elements of said back plate, said pivot point comprising a bolt disposed between, and extending through the side elements of said back plate and the sidewalls of said top plate;

an annular connecting member fixedly connected between a basketball hoop and the front edge of said top plate;

an angle bracket for coupling to the inside back surface of said back plate such that a portion of said angle bracket extends inwardly perpendicular from said back plate and is parallel to said top plate in the resting position, said angle bracket is coupled by a nut and bolt assembly;

a carriage bolt extending from the top surface of said top plate, proximate said back plate, through the inwardly extending portion of said angle bracket;

a retention nut threadedly engaging the carriage bolt and abutting the bottom surface of said top plate;

an elasticity accelerating member disposed beneath the inwardly extending portion of said angle bracket and adapted to receive the carriage bolt;

a first adjustment nut disposed above the inwardly extending portion of said angle bracket and threadedly engaged with the carriage bolt; and a second adjustment nut disposed below said elasticity accelerating member and threadedly engaged with the carriage bolt for adjusting the spring rate of the elasticity accelerating member and position of the basketball hoop relative to a playing surface.

* * * * *